United States Patent [19]

Snell

[11] 4,049,360

[45] Sept. 20, 1977

[54] VARIABLE STATOR VANE ACTUATING MECHANISM

[75] Inventor: Leonard Stanley Snell, Bristol, England

[73] Assignee: Rolls-Royce (1971) Limited, England

[21] Appl. No.: 678,120

[22] Filed: Apr. 19, 1976

[30] Foreign Application Priority Data

May 1, 1975 United Kingdom ..... 18118/75

[51] Int. Cl.[2] ..... F03B 15/06

[52] U.S. Cl. ..... 415/149 R; 74/89.15

[58] Field of Search ..... 415/149, 148, 160; 74/89.15

[56] References Cited

U.S. PATENT DOCUMENTS

| | | | |
|---|---|---|---|
| 2,999,630 | 9/1961 | Warren et al. | 415/149 R |
| 3,568,957 | 3/1971 | Wood | 74/89.15 |
| 3,616,704 | 11/1971 | Martin | 74/89.15 |
| 3,685,920 | 8/1972 | Burge | 415/149 R |
| 3,914,066 | 10/1975 | Downing | 415/149 R |

*Primary Examiner*—C. J. Husar

*Attorney, Agent, or Firm*—Stevens, Davis, Miller & Mosher

[57] ABSTRACT

A mechanism for varying the angle of attack of stator vanes of a compressor in a turbo machine. The vanes in each row are all connected to a respective encircling ring. The rings from all the rows of variable stators are connected to a beam which lies along the outside of the casing. The beam is connected at about its middle to a screw jack actuator which is bolted to the casing and one end of the beam is pivotted to the casing with a compound pivot which accommodates the compound movement of the beam caused by the straight line movement of the screw jack actuator.

3 Claims, 8 Drawing Figures

Figure 1:
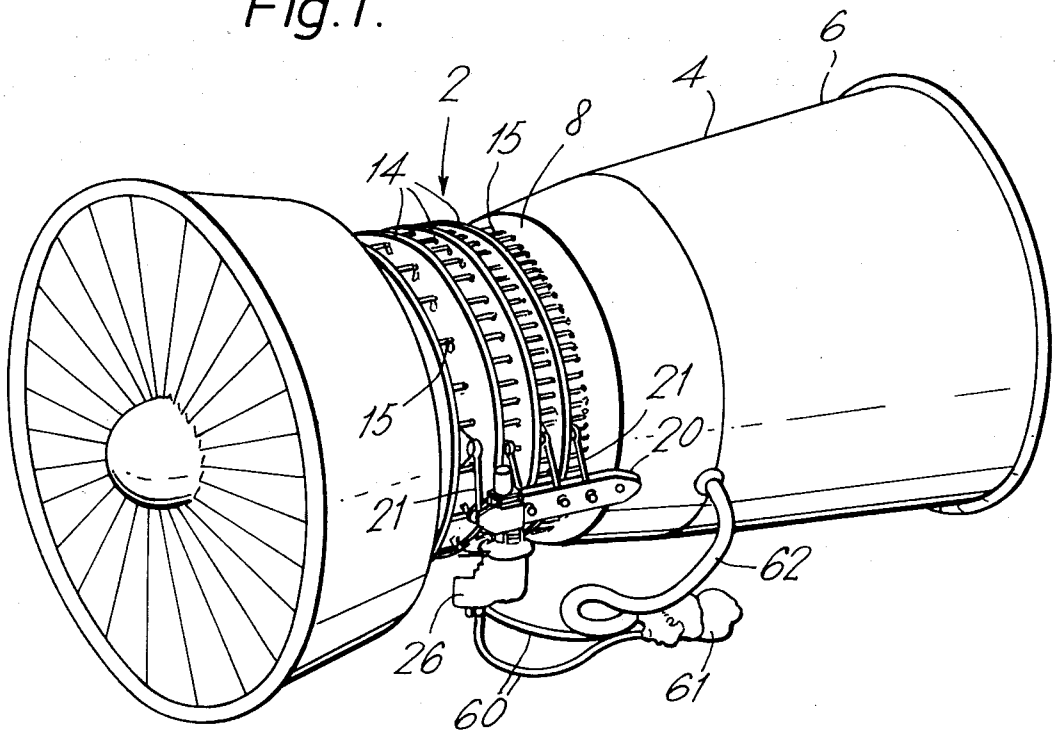

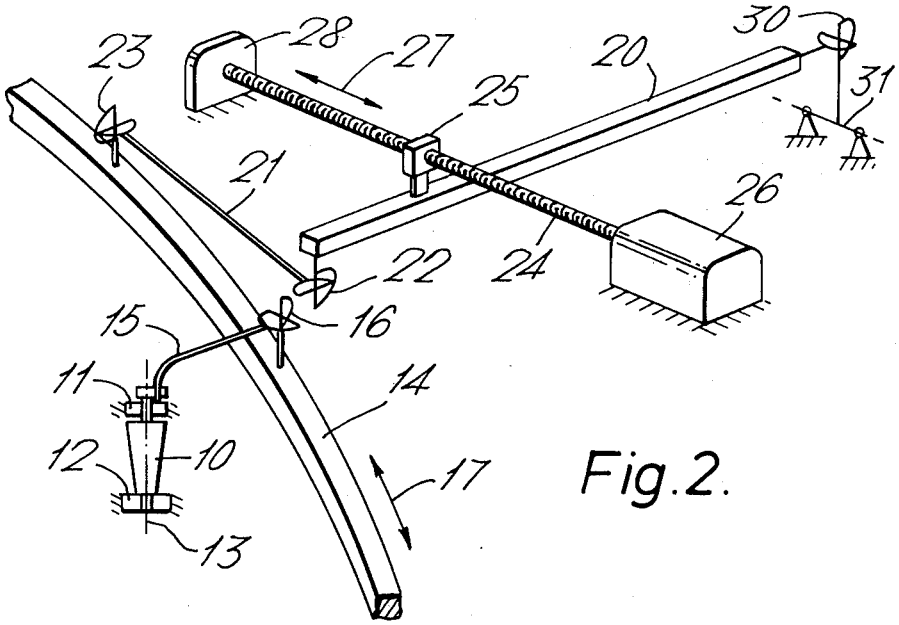
Fig.2.
Fig.3.
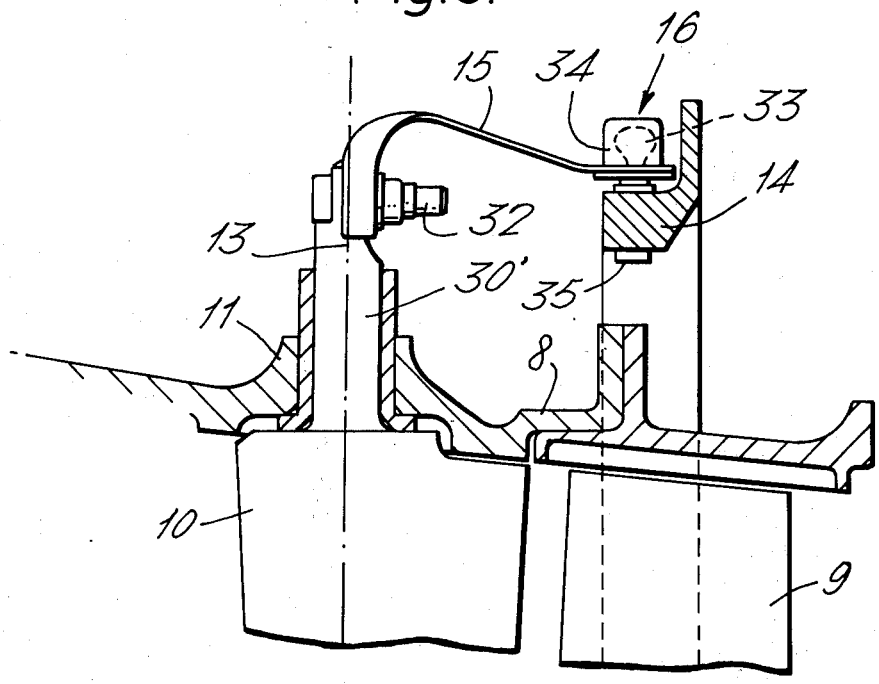

VARIABLE STATOR VANE ACTUATING MECHANISM

The present invention relates to compressors for turbo-machines having variable angle stator vanes and to actuating mechanism for causing variation in the angles thereof.

Stator varying mechanisms are known in which a beam, which may be a single beam, or one of a pair of beams mounted on opposite sides of the compressor casing, is mounted for pivoting movement about one end in a flat plane tangential to the casing, and is actuated at the other end by a suitable actuator.

In such mechanisms the pivot is secured to the casing and it restricts the freedom of movement of the beam and allows pivoting of the beam only in the flat tangential plane. This means that at the other end of the beam there must be a guide which constrains the beam in the same flat plane. The actuator has to be mounted rigidly on the casing and links having universal joints at each end used to connect to the beam. Alternatively, the actuator must itself be pivotably mounted on the casing and universal joints used to take care of the compound movements required in the connection between the beam and the actuator.

These additional features need additional lubrication and maintenance and add to the cost and weight of the engine.

It is an object of the present invention to provide an improved actuating mechanism for variable stators in a turbo-machine in which movement of the beam is positively controlled substantially in a plane tangential to the casing of the compressor, in a simple manner whilst allowing the actuator to be firmly secured to the casing.

Also in these known stator varying mechanisms particularly for gas turbine engines, actuation of the mechanism has been performed using different fluids. By this is meant that the various liquids used in the engine have been utilized for this purpose.

However, the liquids available are fuel, lubricating oil, or hydraulic fluid and there are disadvantages in the use of any of these liquids. For example, the use of fuel to operate actuator jacks presents a possible fire hazard if a fuel line breaks, and can be a potential danger in that the fuel may become overheated if the pipework through which it flows is routed close to the hot parts of the engine. Thus additional complexities have to be built into the system to minimise these risks.

Similarly the use of lubricating or hydraulic oil adjacent hot engine parts can cause coking of the oil with the risk that the dirt so produced will affect the operation of the mechanism.

There is however, a further source of motive power in the engine which avoids these difficulties and that is the air compressed by the compressor. It is a further object of the present invention to provide a mechanism for varying the angles of the vanes of a compressor in a gas turbine engine or any other turbo-machine, which utilizes the air flowing through a compressor of the machine.

According to the present invention there is provided a mechanism for varying the angles of at least one row of stator vanes in a compressor of a turbo-machine, comprising a beam, a casing of the compressor, an actuator which is rigidly mounted on the compressor casing, a member aranged to be driven by the actuator in a straight line which lies tangentially of an imaginary circle, which circle is co-axial with the compressor casing, a first connection between said beam and the driven member, which first connection enables said beam to pivot relative to said driven member but which constrains said beam to move with said driven member with a motion parallel to said straight line, a second connection between said beam and the casing at a position on said beam remote from the first connection, which second connection enables said beam to pivot and to move in the direction of its own longitudinal length relative to said casing so as to accommodate the compound movement caused by the movement constraint of the first connection, and means connecting the beam to the stator vanes whereby movement of the driven member causes variation of the angles of the stator vanes.

In a preferred form of the invention the actuator is a screw jack actuator, having a screw which extends tangentially of the casing and the driven member is a nut which engages the screw and is connected to the beam whereby rotation of the screw causes said movements of the beam, and the actuator is driven by a flexible drive from an air motor which is itself driven by air bled from a compressor of the turbo-machine.

There may be a pair of beams for causing the variation in angle of the stator vanes, in which case two screw jack actuators may be provided which would be synchronised by a pair of flexible drives from the same air motor.

Various means may be incorporated at the fixed end of the beam for providing both the pivoting and longitudinal motion of the beam. For example, the pivot which allows transverse pivoting may be carried on a block mounted on the casing and constrained to slide in the longitudinal direction of the beam, or it may be carried on one end of a leaf spring which is connected at its other end to the casing and is capable of flexing in the longitudinal direction of the beam.

An alternative mounting comprises a pivot which allows transverse pivoting of the beam and which is itself mounted on the compressor casing for pivoting about a transverse axis.

Figure 4:
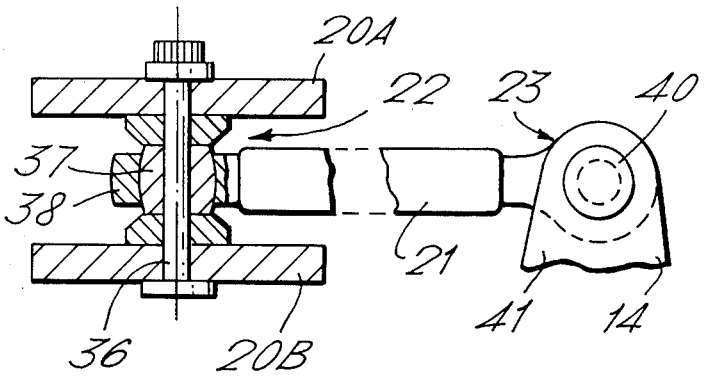
Figure 5:
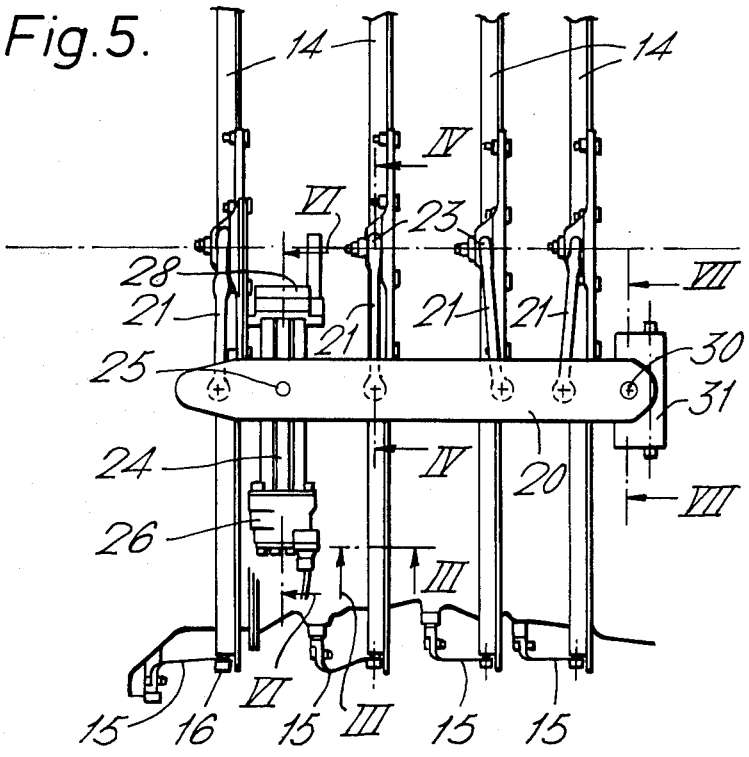
Figure 6:
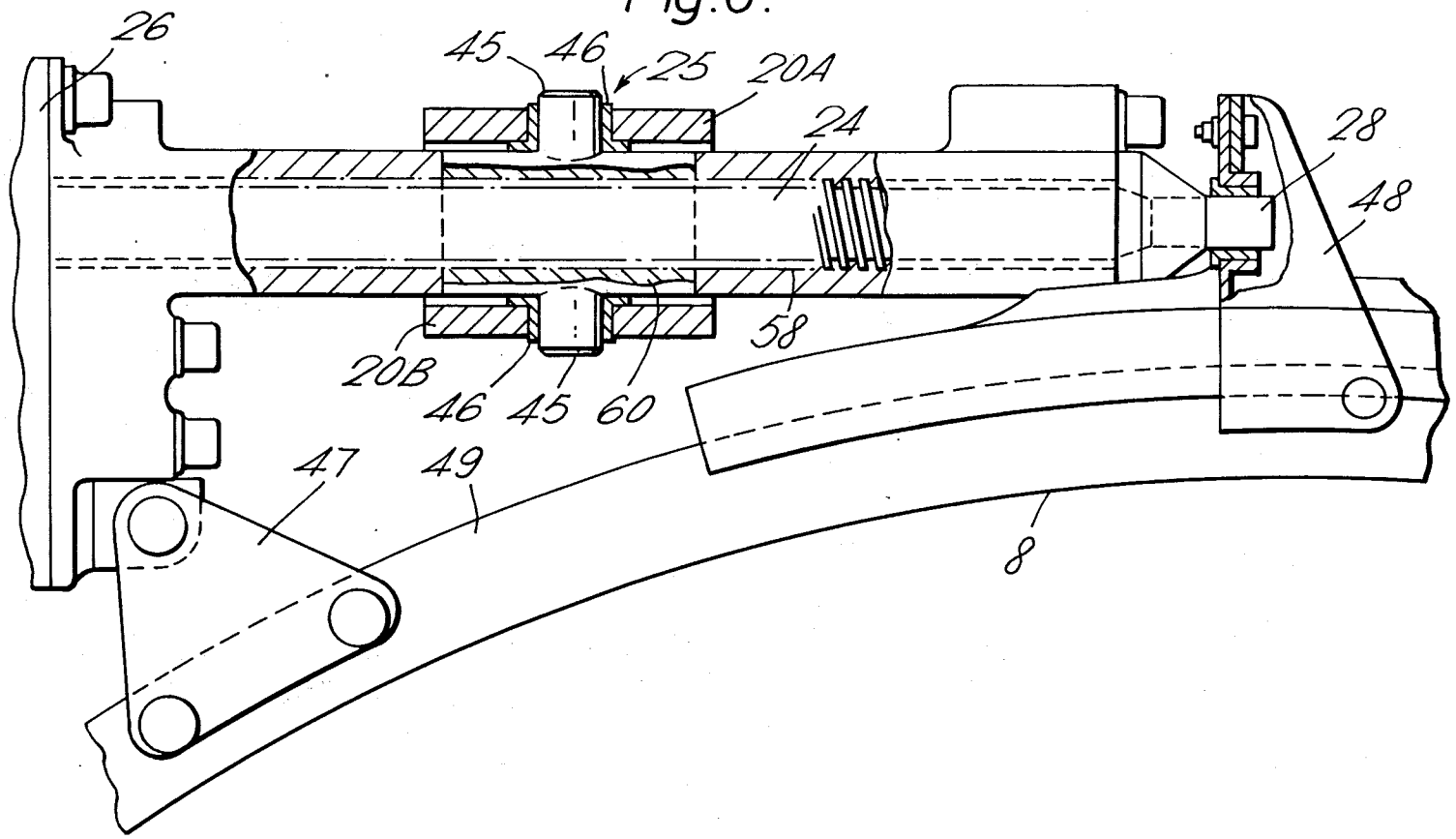
Figure 7:
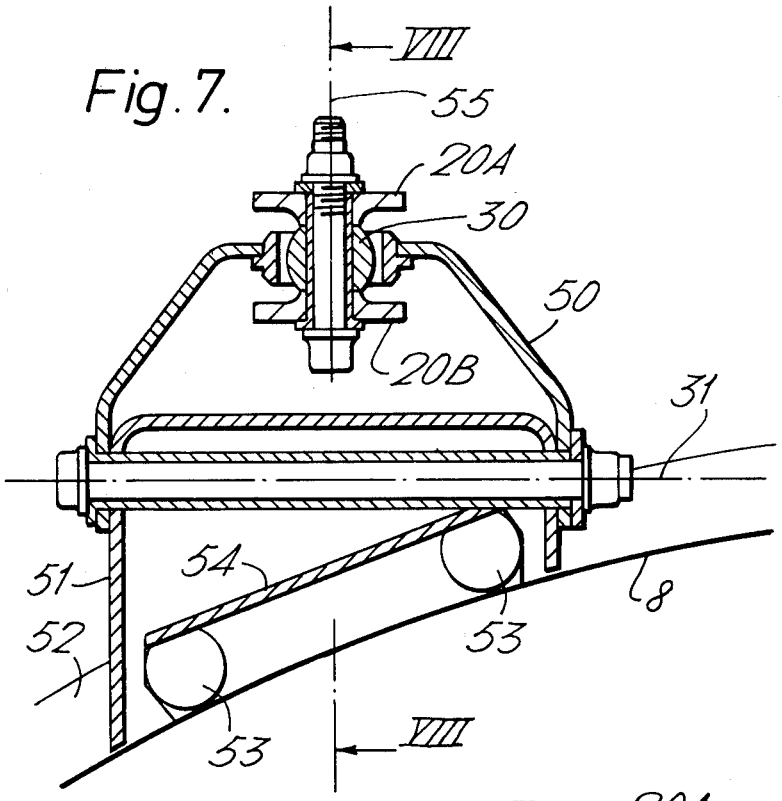
Figure 8:
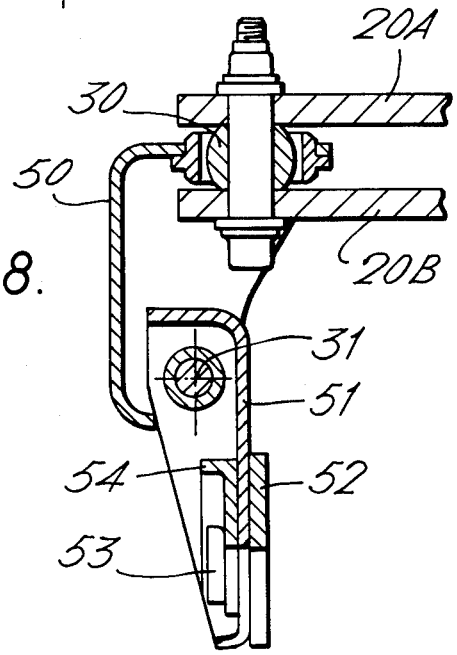

The invention will now be more particularly described, by way of example only, with reference to the accompanying drawings, in which, FIG. 1 is a view of a gas turbine engine incorporating the present invention, FIG. 2 is a diagrammatic representation of a mechanism which incorporates the present invention and is used on the gas turbine engine of FIG. 1, FIG. 3 is a section through a stator vane turning lever and its associated ring taken along the line III—III of FIG. 5, FIG. 4 is a section through a linkage connecting the turning ring to a beam, taken along the line IV—IV of FIG. 5, FIG. 5 is a portion of an exterior view of the engine of FIG. 1, FIG. 6 is a section on line VI—VI of FIG. 5, FIG. 7 is a section on line VII—VII of FIG. 5 to a different scale to FIGS. 5 and 6, and FIG. 8 is a section on line VIII—VIII of FIG. 7.

Referring now to the drawings there is shown in FIG. 1 a gas turbine engine having a compressor section 2, a combustion section 4 and a turbine section 6 all housed in a casing 8. The invention is only concerned with the compressor section 2 so that the remainder of the engine is not described further.

The compressor section comprises alternate rows of rotor blades and stator vanes. Some of the rows of stator vanes are arranged so that their angles of attack can be varied in order to accommodate changes in flow conditions over the whole operating range of the engine. All the vanes of each such row need to have their angles of attack varied by the same amount but different rows of vanes need to have their angles of attack varied by different amounts.

A portion of a stator vane 10 which is one of a row whose angles of attack need to be varied, is shown in FIG. 3, whilst the mechanism for varying the angle of attack of the vane 10 is shown diagrammatically in FIG. 2.

Referring now to FIG. 2 the vane 10 can be seen to be mounted in a radially outer bearing 11 and a radially inner bearing 12 such that it is capable of being turned around the axis 13. All the vanes of the row, of which vane 10 is only one, are similarly mounted and are separately connected at their radially outer ends to a single ring 14 which extends around the outside of the casing 8. Each vane is connected through a flexible link 15 by means of a universal joint 16 to the ring 14. Thus movement of the ring 14 in a substantially rotational manner, as shown by arrow 17, relative to the fore and aft axis of the engine casing, will cause vane 10 and all the other vanes of the row to have their angles of attack varied simultaneously.

The ring 14 is caused to move in this manner by movement of two beams 20 which are diametrically opposed around the casing 8 and which both have the operating mechanism described below and shown in FIG. 2. Each beam 20 is connected to ring 14 by a link 21. Link 21 has a coupling 22 at one end for connection to the beam 20 and a coupling 23 at the other end for connection to the ring 14. The beam 20 is moved by rotation of a screw jack 24 which carries a driven member in the form of a running nut 25 and this in turn is pivotally connected to beam 20. Screw jack 24 is rotated by an actuator 26 and this causes nut 25 to move in a straight line as shown by arrow 27. Actuator 26 and a bearing 28 are mounted on the casing 8 and together support screw jack 24 so that nut 25 is constrained to move in a straight line which is tangential to an imaginary circle concentric with the engine casing.

The further end of beam 20 is connected to the casing 8 but this connection includes a coupling 30 and an offset pivot 31 so that the connection at this end of beam 20 can accommodate the combined swinging motion of beam 20 plus a small amount of displacement along the longitudinal length of beam 20 caused by nut 25 being constrained to move in a straight line. It will be understood that a series of rings 14 is connected to beam 20, there being one ring 14 for each row of stator vanes requiring to have their angles of attack varied during engine operation. Because of the form of connection between beam 20 and nut 25, the portion of beam 20 adjacent the connection is constrained to move in a straight line parallel to the longitudinal axis of screw jack 24. The end of the beam connected to the casing through connection 30, 31 essentially pivots about that end but additionally moves longitudinally of the beam to accommodate the compound motion of the beam.

Actuator 26 (of which there are in fact two diametrically disposed around the engine casing 8) is driven through a flexible drive 60 from an air motor 61, which is of conventional type. Motor 61 is supplied with air from the compressor section of the engine by means of an air bleed via ducting 62.

Further details of vane 10 and ring 14 are shown in FIG. 3 which shows the outer portions of vane 10 and its adjacent rotor blade 9. Stator vane 10 has a trunnion 30' on its radially outer extremity which extends radially outwardly through bearing 11 in casing 8 and terminates in an eye for receiving a bolt 32. Attached by the bolt 32 to the trunnion 30' is one end of the flexible link 15, the other end of which is attached to the ring 14 through the coupling 16 comprising a ball 33 and socket 34. Ball 33 is secured by pin 35 to ring 14. Thus rotation of ring 14 in a plane perpendicular to the plane of FIG. 3 will cause trunnion 30 to turn and vary the angle of attack of blade 10. However, the motion of ring 14 will include a component parallel to the fore and aft axis of the engine because each connection 16 will be constrained to move in an arc about its respective axis 13.

Referring now to FIG. 4, one link 21 and the detail of its connection to both beam 20 and ring 14 are shown. Beam 20, in fact, comprises a pair of elongate plates 20A, 20B. The connection 22 of link 21 to beam 20 consists of a bolt 36 extending through plates 20A, 20B and on which is mounted a spherical member 37. Link 21 is formed with a head at 38 having an interior spherical surface conforming with spherical member 37 to enable link 21 to have a limited degree of pivotal movement in two mutually perpendicular directions relative to beam 20.

The connection 23 at the other end of link 21 is similar to connection 22 and comprises a bolt 40 secured to a flange 41 upstanding from ring 14 and including a spherical connection giving two degrees of relative movement between link 21 and ring 14, the arrangement being similar to that of connection 22 although the detail of this connection is not shown in FIG. 4.

Referring now to FIG. 5 it can be seen that the engine has four rows of stator vanes requiring variation to their angles of attack. Each of these rows has a ring 14 and each ring 14 is connected through links 15 to the respective stator vanes. Each ring 14 is connected through links 21 to the two beams 20, one of which is shown in FIG. 5.

FIG. 6 shows the connection of beam 20 to the screw jack 24 through running nut 25. The nut 25 is formed integrally with two trunnions 45 which fit into bushes 46 respectively in the two plates 20A, 20B which constitute the beam 20. The nut 25 engages the screw jack 24 so that rotation of the screw jack by actuator 26 causes the nut 25 and with it the beam 20, to move along the length of the screw jack 24.

The body of the actuator 26 is rigidly connected to the casing 8 through a mounting bracket 47, while the other end of screw jack 24 runs in trunnion bearing 28 which is rigidly connected to casing 8 through a bracket 48. Brackets 47 and 48 are both bolted to a flange 49 of casing 8. The screw jack mounting is such that it extends substantially tangentially of the casing. Thus the beam is constrained to move in a flat plane as it moves along the screw, and can only move tangentially of the casing.

The mounting at the other end of the beam 20 is shown in FIGS. 7 and 8. Sandwiched between the two plates 20A, 20B of the beam is the ball and socket connection 30, which allows the beam to pivot about its end. In addition, the ball and socket connection 30 is carried on a bracket 50 which in turn is pivotally mounted on a second bracket 51 which is bolted to a flange 52 of the compressor casing 8 by means of bolts 53. Due to the particular mounting of the pivot on the bracket 50, the axis of pivoting of the beam is not exactly radial in this example, although a modification to the bracket mounting could easily be made to produce a radial axis for this pivot. The bolts 53 are 'D' head bolts which are trapped by means of a plate 54.

It can be seen therefore that as the screw jack 24 moves the beam, the beam will not only pivot about a substantially radial axis 55, but will also rock slightly along its length back and forth on the pivoted bracket 50 about axis 31. This compound pivoting action allows the rigidly mounted actuator to operate without binding.

Clearly, alternative mounting arrangements are possible, for example, instead of the ball and socket being mounted on a pivoting bracket, it could be mounted on a block for sliding movement in a plane tangential to the casing, or on a leaf spring capable of flexing substantially longitudinally of the beam.

Further advantages of the above described system are as follows:

1. The screw jack is irreversible so that should there be a failure in any part of the drive, the mechanism will fail in its last set position.

2. The two flexible drives to the actuators are driven by the same motor and are therefore mechanically linked and synchronised.

3. The system is completely self-contained and can be fitted as a module, i.e. there are no fuel lines or hydraulic lines from other parts of the engine which must be disconnected for dismantling the mechanism.

I claim:

1. In a turbo-machine having a casing and a compressor with at least one row of stator vanes which are angularly adjustable, a mechanism comprising a beam connected at one end to the casing through a universal joint and a pivot offset therefrom, a beam driving member, means mounting said member for movement in a straight line tangent to an imaginary circle, which is coaxial with the compressor casing, an actuator for driving said beam driving member along said straight line, means pivotally connecting said beam to said beam driving member at a position remote from the end of the beam, which is connected to the casing through said universal joint and said pivot, said pivot being offset from said universal joint so as to enable the beam to move in the direction of its own longitudinal length relative to said casing by motion at the pivot and at the universal joint and to enable the beam simultaneously to move by motion at the universal joint when the beam driving member is driven along said straight line by the actuator, a ring, and means connecting the beam through universal joints to said ring, and means connecting said ring to the stator vanes whereby movement of the driving member causes variation of the angles of the stator vanes.

2. A mechanism according to claim 1 further comprising an air motor, means to feed air from said compressor to said motor, and a flexible drive connecting said motor to said actuator.

3. A mechanism according to claim 1 wherein said actuator is a nut and the means mounting it for movement in a straight line is a screw.

* * * * *